US005295195A

United States Patent [19]

Mitobe et al.

[11] Patent Number: 5,295,195

[45] Date of Patent: Mar. 15, 1994

[54] MAGNETIC CIRCUIT IN A LOUDSPEAKER

[75] Inventors: Kunio Mitobe; Yutaka Moriyama, both of Yamagata, Japan

[73] Assignees: Tohoku Pioneer Electronic Corp., Tendo; Pioneer Electronic Corp., Tokyo, both of Japan

[21] Appl. No.: 903,382

[22] Filed: Jun. 24, 1992

[30] Foreign Application Priority Data

Jan. 30, 1992 [JP] Japan ..... 4-42189

[51] Int. Cl.[5] ..... H04R 25/00

[52] U.S. Cl. ..... 381/199; 381/204

[58] Field of Search ..... 381/199, 204, 205, 188, 381/192

[56] References Cited

U.S. PATENT DOCUMENTS 4,508,941 4/1985 Wiggins ..... 381/199
5,150,419 9/1992 Kizak et al. ..... 381/199
5,157,731 10/1992 Mitobe ..... 381/199

FOREIGN PATENT DOCUMENTS 46-8272 3/1971 Japan .
3-155777 7/1991 Japan .

OTHER PUBLICATIONS

U.S. Patent Application S.N. 666,763.

*Primary Examiner*—Forester W. Isen
*Assistant Examiner*—Sinh Tran
*Attorney, Agent, or Firm*—Nikaido, Marmelstein Murray & Oram

[57] ABSTRACT

A magnetic circuit has a yoke base, a pole formed on the yoke base, an annular magnet mounted on the yoke base, an annular plate having an inclined surface mounted on the magnet. The annular plate has an inwardly downwardly curved sectional shape toward a periphery. A frame for a conical diaphragm is secured to the plate. A plurality of platforms each having a flat surface are formed on the inclined surface, and a plurality of staking projections are formed on the flat surfaces of the platforms. The frame is secured to the plate by staking the staking projections.

6 Claims, 3 Drawing Sheets

MAGNETIC CIRCUIT IN A LOUDSPEAKER

BACKGROUND OF THE INVENTION

The present invention relates to a plate of a magnetic circuit in a loudspeaker.

In an electrodynamic loudspeaker, which is widely used, an electric signal is converted into an acoustic signal by magnetic flux generated by a magnet and by the magnetic force caused by the electric signal.

Referring to FIG. 1, a cone loudspeaker, which is one type of electrodynamic loudspeaker, has a yoke 12 with an integral center pole 11 and a yoke base 13, an annular magnet 14 mounted on the yoke base 13, and an annular plate 15 mounted on the magnet 14, thereby forming a magnetic circuit. On the plate 15 is mounted a conical frame 20 which supports a conical diaphragm 23 around an upper edge thereof at an edge 21. A lower edge of the diaphragm 23 is disposed in a magnetic gap G formed between the center pole 11 of the yoke 12 and the plate 15 and secured to a voice coil 22 which is supported by a damper 24. The voice coil 22 is disposed in the magnetic gap G to be moved in the direction shown by arrows a and b. A lead 30 connects the voice coil 22 to an external terminal 31 which is connected to an external source to feed audio current to the voice coil 22. When applied with the audio current, the voice coil 22 generates a magnetic force, which moves the voice coil 22 itself. The diaphragm 23 is thus caused to vibrate to produce sound waves.

In the speaker, the base 13 has a uniform thickness as shown in FIG. 1. In such a speaker there is a large leakage flux, which causes the magnetic flux generated in the magnetic gap G to reduce. Japanese Utility Model Publication No. 46-8272 discloses a yoke where the thickness is reduced toward the peripheral portion thereof to prevent the reduction of the magnetic flux.

The inventors of the present invention have proposed a magnetic circuit in Japanese patent application no. 2-280773 (U.S. Ser. No. 666,763) which is shown in FIG. 2. A yoke **12*a* and a plate 15*a* are slanted toward the periphery. The upper surface of the plate 15*a* has an inwardly curved sectional shape 17 and the lower surface of a yoke base 13*a* has also a curve 16 so that each of the peripheral portions thereof is extremely thinned down. A loudspeaker having such an arrangement is advantageous in that the magnetic flux flows mainly through the gap G so that a leakage flux $\phi 1$ between the plate 15*a* and the yoke base 13*a*, detouring the magnet 14, is decreased. A leakage flux $\phi 2$ which flows from the plate 15*a* to the center pole 11** is also decreased.

At the same time, the circuit becomes thinner and lighter in weight.

Japanese Patent Application Laid-open No. 3-155777 also proposed by the inventors discloses a method for manufacturing a plate by cold forging. In the method, a die having a draft on the periphery thereof is used for producing the plate, thereby ensuring the dimensional accuracy of the plate. Thus, the plate having a thin peripheral portion is manufactured with accurate dimensions, and the magnetic circuit having the intended characteristic in the design of the speaker is obtained.

The plate 15 of FIG. 1 is secured to a base portion of the frame 20 with adhesive or bolts. However, the plate **15*a* of FIG. 2 has the surface inwardly curved without a flat portion. Consequently, it is difficult to secure the frame 20 to the plate 15*a***.

In order to secure the frame 20 to the curved plate **15*a* with screws, threaded holes are formed in the base portion of the frame and the plate. Furthermore, in order to form a horizontal surface on the plate 15*a***, it is necessary to provide an element which has a surface corresponding to the inclined surface of the plate, thereby causing an increase in the number of parts.

SUMMARY OF THE INVENTION

An object of the present invention is to provide a plate of a magnetic circuit for a loudspeaker where a frame of the speaker is easily secured to the plate.

According to the present invention, there is provided a magnetic circuit for a loudspeaker having a yoke base, a pole formed on the yoke base, an annular magnet mounted on the yoke base, an annular plate having an inclined surface and a flat underside and mounted on the magnet so as to form a gap between an inside wall thereof and an outer wall of the pole, the annular plate having an inwardly downwardly curved sectional shape toward a periphery, and a frame for a conical diaphragm to be secured to the plate.

A plurality of platforms each having a flat surface are formed on the inclined surface, the flat surface being parallel with the flat underside, and a plurality of staking projections are formed on the flat surfaces of the platforms.

The frame is secured to the plate by staking the staking projections.

In one aspect of the invention, the platforms each comprise an annular platform and a radial branch platform formed around the annular platform.

The other objects and features of this invention will become understood from the following description with reference to the accompanying drawings.

DETAILED DESCRIPTION OF THE PREFERRED EMBODIMENT

Figure 1:
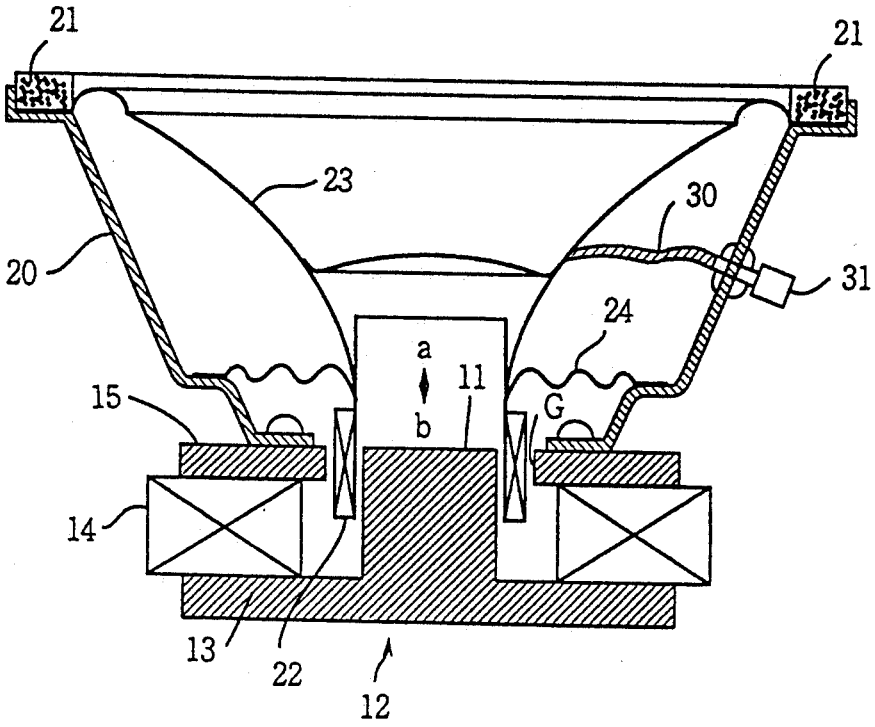
FIG.1 PRIOR ART
FIG. 1 is a sectional view of a conventional cone loudspeaker.
Figure 2:
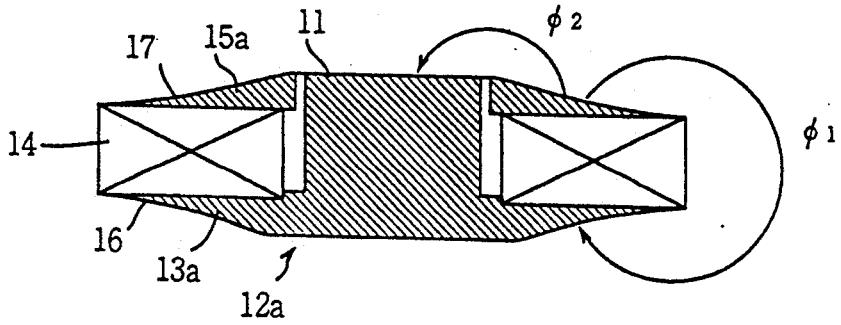
FIG.2 PRIOR ART
FIG. 2 is a sectional view showing a magnetic circuit for a loudspeaker which has been proposed by the inventors.
Figure 3:
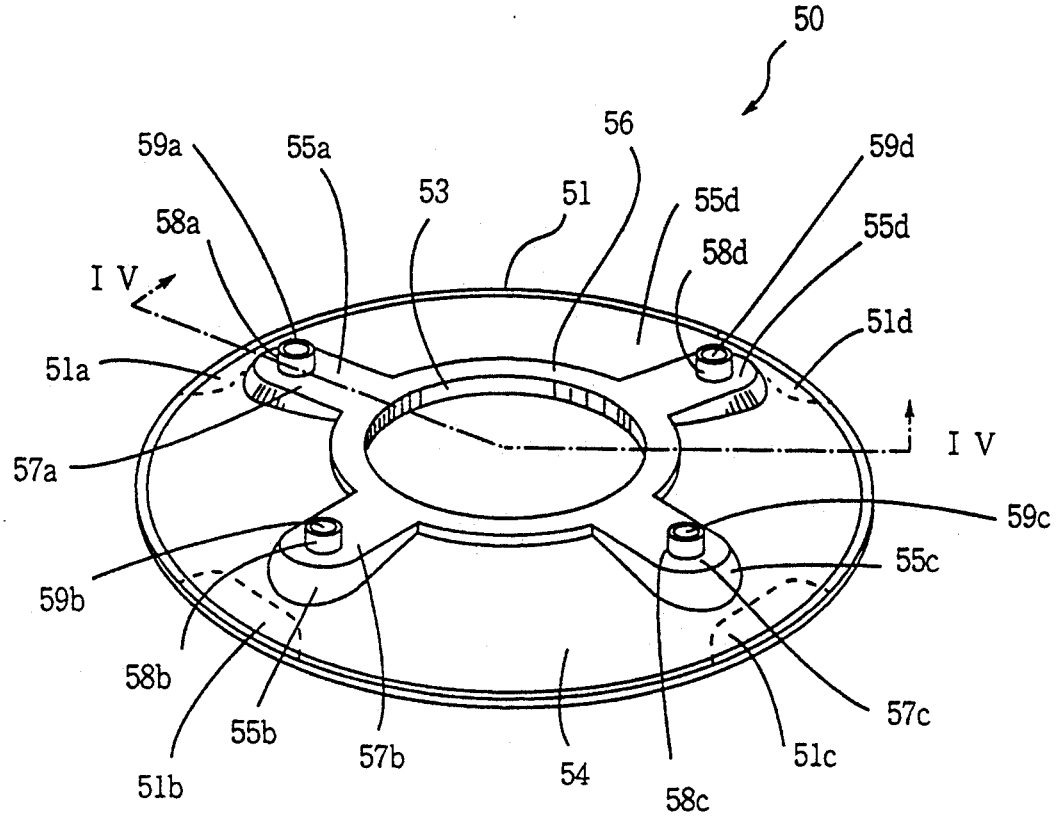
FIG. 3 is a perspective view showing a plate of the magnetic circuit according to the present invention.
Figure 4:
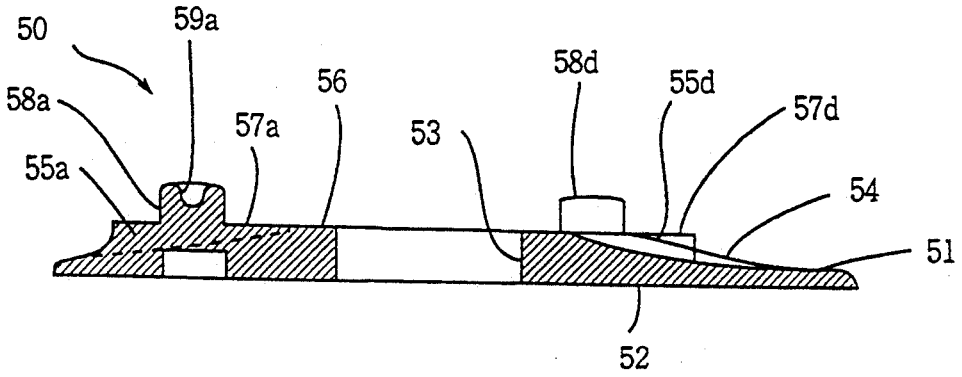
FIG. 4 is a sectional view of the plate taken along a line IV–IV of FIG. 3.

Referring to FIGS. 3 and 4, an annular plate 50 of the magnetic circuit according to the present invention has a central opening 53 for the center pole 11, a flat underside 52, and an upper curved surface 54 inwardly and downwardly curved from the opening 53 to a peripheral portion 51 thereof. On the upper curved surface 54, an annular platform support 56 having a horizontal supporting face is formed around the opening 53. A plurality of branch platform supports **55*a* to 55*d* are provided on the curved surface 54 to radially extend from the annular platform 56 to the peripheral portion of the plate 50. The branch platforms are disposed at the equidistance intervals in the circumferential direction. The branch platforms 55*a* to 55*d* have flat surfaces 57*a* to 57*d* respectively which are flush with the surface of the annular platform 56. Those flat surfaces are formed parallel with the flat underside 52. The branch platforms 55***a* to 55*d* are provided with cylindrical staking projections 58*a* to 58*d* having holes 59*a* to 59*d*, respectively, to be engaged with holes of a base portion of a conical frame of the loudspeaker.

The plate 50 is manufactured by cold forging in one-piece. The branch platforms 55*a* to 55*d* are formed by plastic flow when the thickness of the plate is decreased toward the peripheral portion 51. Alternatively, a plurality of excess portions 51*a* to 51*d* are formed on the peripheral portion 51 corresponding to the branch platforms 55*a* to 55*d* so that the plastic flow may be positively performed from the excess portions to the branch platforms.

Figure 5:
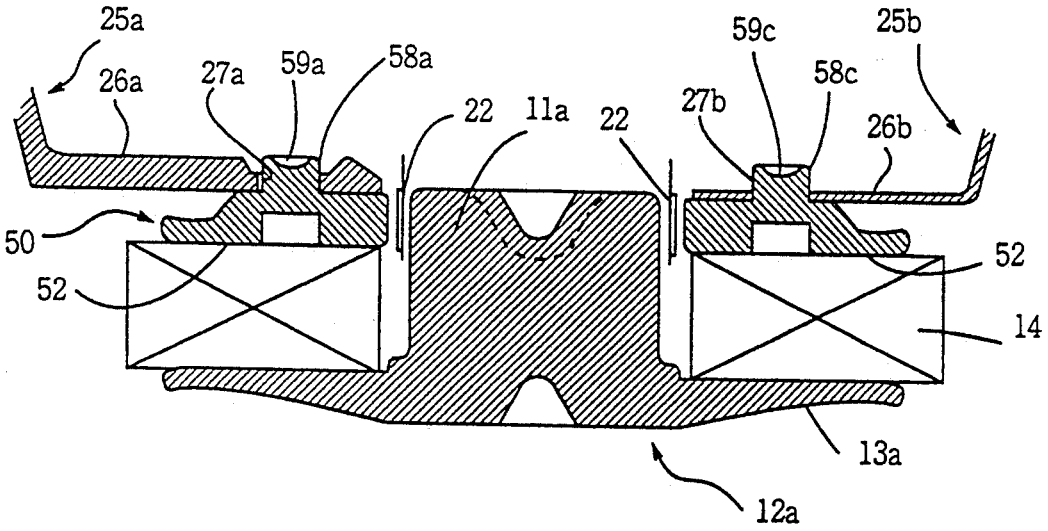
FIG. 5 is a sectional view showing a main part of a loudspeaker of the present invention.

Referring to FIG. 5, the plate 50 is disposed corresponding to the magnet 14 at the flat surface 52. A conical frame 25*a* made of plastic is mounted on the plate 50. The plastic frame 25*a* has a flat base portion 26*a* provided with holes 27*a* to be engaged with the staking projections 58*a* to 58*d* of the plate. In place of the plastic frame 25*a*, a metal frame 25*b*, for example made of iron, can be also used as shown in FIG. 5. Similar to the frame 25*a*, the iron frame 25*b* has a flat base portion 26*b* having holes 27*b* corresponding to the staking projections.

The flat base portion 26*a* is mounted on the branch platforms 55*a* to 55*d* and the annular platform 56 of the plate 50, while the staking projections 58*a* to 58*d* of the plate are inserted into the corresponding holes 27*a*. An end of a staking punch (now shown) is inserted into each of the holes 59*a* to 59*d* of the staking projections 58*a* to 58*d* to press the projection onto the base portion 26*a* so that the pressed projection is expanded. As a result, the base portion 26*a* is fastened to the platform of the plate 50 by staking. Thus, the frame 25*a* is secured to the plate.

Since the frame 25*a* is positioned by the staking projections and holes, the frame is firmly fixed to the plate 50 with excellent dimensional accuracy.

Before staking, the base portion 26*a* may be secured to the upper surfaces 57*a* to 57*d* with adhesive.

The plate 50 integrated with the frame 25*a* is mounted on the magnet 14 mounted on the yoke base 13*a* of the yoke 12*a*, inserting a center pole 11*a* to the opening 53. The voice coil 22 is disposed in the gap between the pole 11*a* and the plate 50.

By using the magnetic circuit having the plate of the present invention, sound having good quality is reproduced. The magnetic flux density in the circumferential direction periodically varies due to the projections of branch platforms 55*a* to 55*d*. Hence the magnetic flux acted on the voice coil 22 has the same periodic variation so that a large magnetic flux is prevented from locally exerting on the voice coil. As a result, the voice coil 22 is moved corresponding to the input level with accuracy, thereby reproducing sound of good quality.

In accordance with the present invention, the frame of the speaker is easily mounted on the plate of the magnetic circuit with dimensional accuracy without threading or other attachments. Since the frame is fastened to the plate by staking with pressure, the fixed position of the plate and the frame is prevented from deviation. Consequently, the mounting structure of the plate is simplified and the loudspeaker having a good reproducing characteristic is obtained in accordance with the plate having curved surfaces.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A magnetic circuit for a loudspeaker having a yoke base, a pole formed on the yoke base, an annular magnet mounted on the yoke base, an annular plate having an inclined surface and a flat underside and mounted on the magnet so as to form a gap between an inside wall thereof and an outer wall of the pole, the annular plate having an inwardly downwardly curved sectional shape toward a periphery, and a frame for a conical diaphragm to be secured to the plate, characterized in that a plurality of branch platform supports each having a flat surface are integrally formed on the inclined surface, the flat surface being parallel with the flat underside;

a plurality of staking projections are each formed on the flat surfaces of the platforms; and the frame is secured to the plate by staking the staking projections.

2. A magnetic circuit according to claim 1, wherein the plurality of branch platform supports comprise an annular platform and radial branch platforms formed around the annular platform.

3. An annular plate for a magnetic circuit in a loudspeaker having a yoke base, a pole formed on the yoke base, an annular magnet mounted on the yoke base with the annular plate being mounted on the magnet so as to form a gap between an inside wall thereof and an outer wall of the pole and a frame for a conical diaphragm to be secured to the plate, the annular plate comprising:

an inclined top surface having an inwardly downwardly curved sectional shape toward an outer periphery thereof;

a flat underside surface;

a plurality of branch platform supports having a flat surface integrally formed on said inclined top surface, the flat surface being defined parallel with said flat underside surface of the annular plate; and a plurality of staking projections each formed on the flat surface of said plurality of branch platform supports, wherein the frame is secured to the plate by staking said plurality of staking projections.

4. An annular plate according to claim 3, wherein said plurality of branch platform supports include an annular platform and radial branch platforms formed around the annular platform.

5. A magnetic circuit device for a loudspeaker, comprising:

a yoke base;

a pole formed on said yoke base;

an annular magnet mounted on said yoke base;

an annular plate having an inclined surface and a flat underside, said annular plate being mounted on said magnet so as to form a gap between an inside wall thereof and an outer wall of said pole, said annular plate having an inwardly downwardly curved sectional shape toward a periphery thereof, and a frame for a conical diaphragm to be secured to said plate;

a plurality of branch platform supports each having a flat surface integrally formed on the inclined surface of said annular plate, the flat surface being parallel with the flat underside of said annular plate; and a plurality of staking projections each formed on the flat surfaces of said plurality of branch platform supports, wherein said frame is secured to said plate by staking said plurality of staking projections.

6. A magnetic circuit device according to claim 5, wherein said plurality of branch platform supports comprise an annular platform and radial branch platforms formed around the annular platform.

* * * * *